United States Patent [19]

Ito

[11] Patent Number: 4,700,105

[45] Date of Patent: Oct. 13, 1987

[54] SHADOW MASK MOUNT FOR COLOR PICTURE TUBE

[75] Inventor: Hideya Ito, Nagaokakyo, Japan

[73] Assignee: Mitsubishi Denki Kabushiki Kaisha, Tokyo, Japan

[21] Appl. No.: 883,689

[22] Filed: Jul. 9, 1986

[30] Foreign Application Priority Data

Sep. 30, 1985 [JP] Japan ..... 60-219398

[51] Int. Cl.[4] ..... H01J 29/07

[52] U.S. Cl. ..... 313/407; 313/408

[58] Field of Search ..... 313/407, 408, 406

[56] References Cited

U.S. PATENT DOCUMENTS 4,327,307 4/1982 Penird et al. ..... 313/407

FOREIGN PATENT DOCUMENTS 0130032 7/1985 Japan ..... 313/407

*Primary Examiner*—Palmer C. DeMeo

*Attorney, Agent, or Firm*—Sughrue, Mion, Zinn, Macpeak and Seas

[57] ABSTRACT

A plurality of spaced reinforcing plates 6 are provided around the periphery of a Hip Up configured shadow mask 2 and its support frame 3 in a color picture tube assembly to strengthen and stiffen the mounting arrangement and thereby reduce Z axis deviations of the mask due to thermal deformation and/or mechanical shock.

7 Claims, 15 Drawing Figures

SHADOW MASK MOUNT FOR COLOR PICTURE TUBE

BACKGROUND OF THE INVENTION

This invention relates to a color television picture tube with an improved shadow mask mounting to minimize misalignments caused by thermal deformations and/or shock vibrations.

FIG. 1 shows a conventional color picture tube having an apertured shadow mask 2 to implement color selection or separation in the usual manner. The mask is mounted in a support frame 3, which is in turn mounted to the inner edges or skirt of a phosphor screen 1 by spring arms 4 attached to panel pins 5 extending inwardly from the screen.

The distance Q (FIG. 4) between the shadow mask 2 and the inner surface of the screen 1 is determined by:

$$Q=(L\times P)/(3\times S),$$

wherein L is the distance between the electron gun and the screen, S is the interval between the electron beams emitted from the gun, and P is the pitch or spacing between the shadow mask apertures. As may be seen from the equation, Q increases as L and P become larger and as S becomes smaller, which follows the current industry trend towards larger color picture tubes and smaller electron guns.

As a result of these large Q distances between the screen 1 and the shadow mask 2, the support frame 3 often projects beyond the skirt 11 of the screen as shown in FIGS. 2 and 4. Such projection creates a particular problem during the process of assembling the screen and the shadow mask; during assembly the screen faces upwardly as seen in FIG. 4 and the support frame thus receives the full weight of the screen. This leads to the deformation of the frame and thus the shadow mask, which in turn causes misalignment between the mask apertures and the phosphor dots or stripes on the screen.

In an effort to solve this problem the construction shown in FIG. 3 has been proposed, wherein the edge of the shadow mask, beginning at point D, is bent to form an unapertured, outwardly extending flange or step portion 22 perpendicular to the tube axis Z. Such a construction is termed a Hip Up configuration, and while it avoids the support frame projection problem, it renders the shadow mask unduly susceptible to Z axis deviations due to thermal deformation as shown in FIG. 5(A) and mechanical shock as shown in FIG. 6(A). Such deviations result from the low degree of stiffness in the vicinity of the step portion 22 and the skirt 21 of the shadow mask, which again leads to misalignment between the mask apertures and the screen phosphors.

SUMMARY OF THE INVENTION

The present invention handily avoids the drawbacks and disadvantages attendant with the prior art constructions by providing a plurality of reinforcing plates appropriately spaced around the support frame and configured to strengthen and stiffen the mounting of the flange and skirt portions of the shadow mask to the frame.

DETAILED DESCRIPTION OF THE PREFERRED EMBODIMENTS

Figure 7:
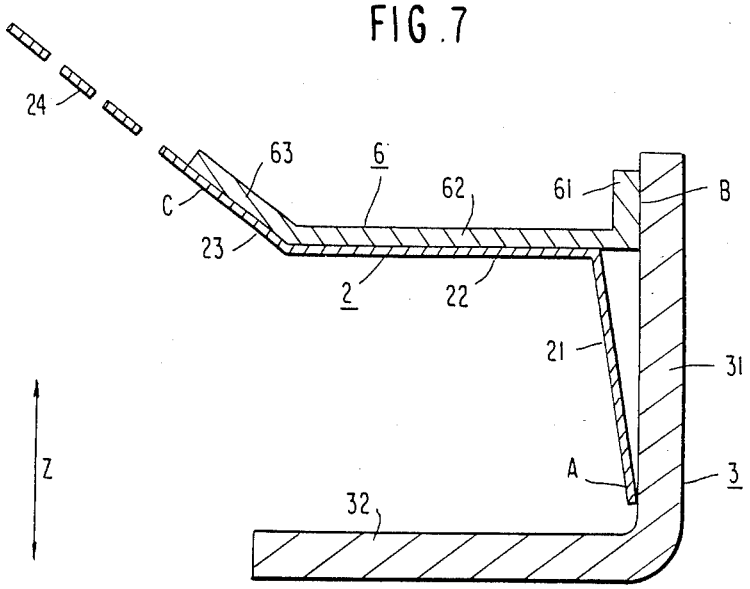
FIG. 7 is an enlarged edge section showing a shadow mask mounting according to a first embodiment of the invention.

Referring to the first embodiment of the invention as illustrated in FIG. 7, the support frame 3, whose overall configuration would be generally rectangular, includes a flange portion 32 perpendicular to the Z axis of the picture tube and a skirt portion 31 generally parallel to the Z axis. The substantially rectangular shadow mask 2 includes a downwardly depending skirt portion 21 spot or plug welded to the shadow mask skirt at spaced points A, a planar unapertured flange or step portion 22 perpendicular to the Z axis, a similarly unapertured curved portion 23, and the usual curved or dome-shaped central portion 24 having a plurality of precisely positioned beam separation apertures.

Figure 1:
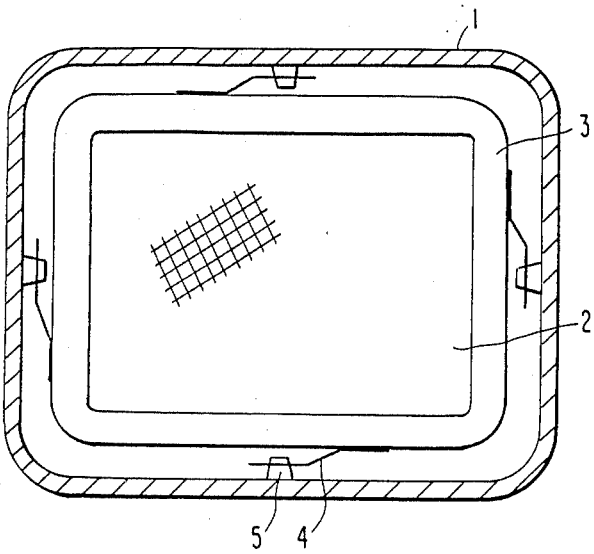
FIG. 1 PRIOR ART
FIG. 1 is a sectional view of a screen and shadow mask of a conventional color picture tube.
Figure 2:
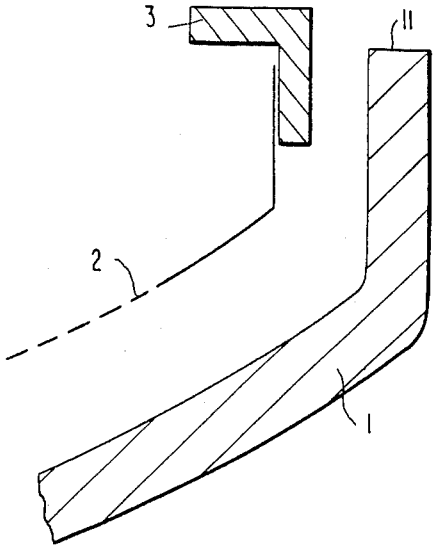
FIG. 2 PRIOR ART
FIG. 2 and FIG. 3 are edge sections showing two conventional configurations of a shadow mask support frame and a picture tube screen.
Figure 3:
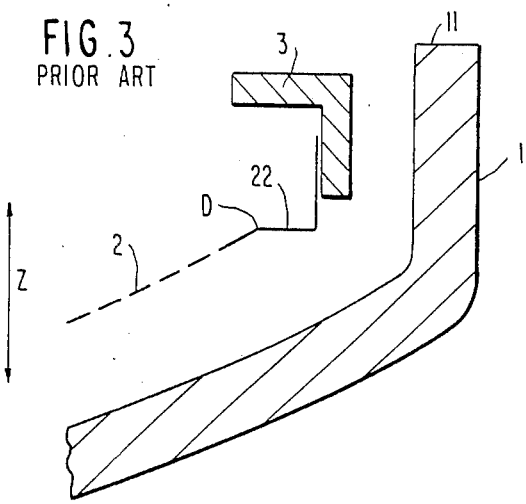
FIG. 3 PRIOR ART
Figure 5A:
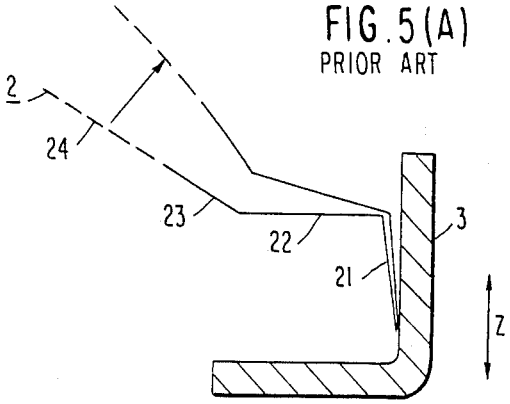
FIG. 5(A) PRIOR ART
FIG. 5(A) and FIG. 5(B) are comparative edge sections showing shadow mask deviations due to thermal deformation in a conventional construction and in a construction according to the invention, respectively.
Figure 5B:
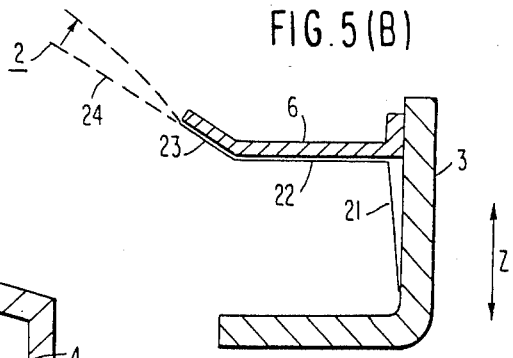
Figure 4:
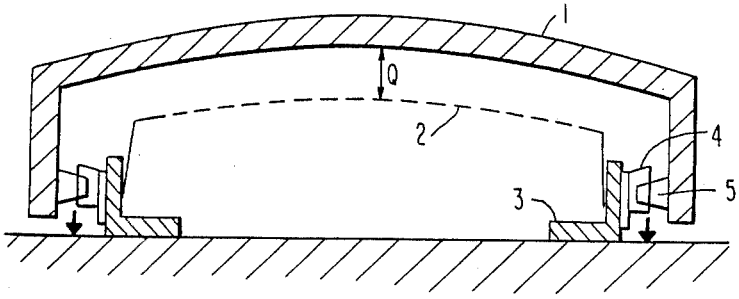
FIG. 4 PRIOR ART
FIG. 4 is a sectional elevation showing a conventional assembly of color picture tube elements.
Figure 6A:
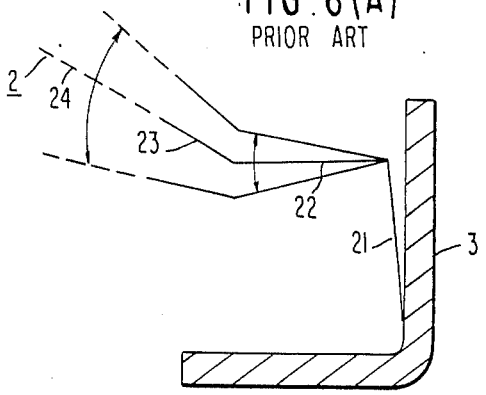
FIG. 6(A) PRIOR ART
FIG. 6(A) and FIG. 6(B) are similar comparative edge sections showing mask deviations due to mechanical shock in the conventional and invention constructions, respectively.
Figure 6B:
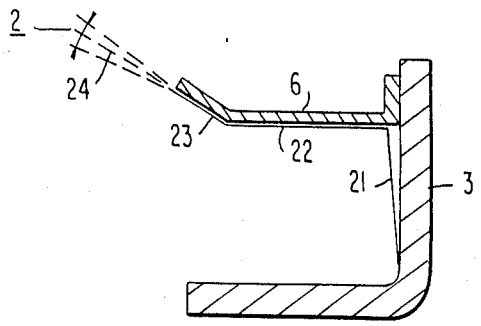
Figure 8:
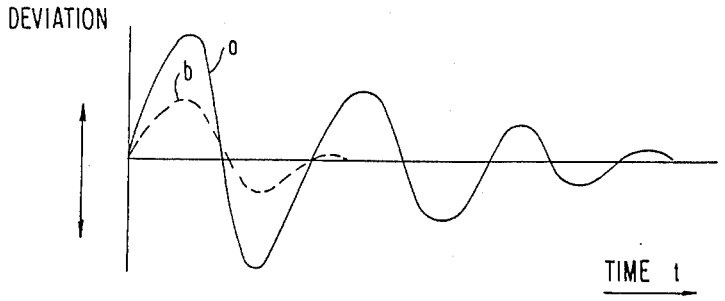
FIG. 8 is a comparative waveform diagram showing the magnitude and attenuation of shadow mask deviations due to mechanical shock for the conventional and invention constructions.

In accordance with the invention a plurality of spaced reinforcing plates 6 are provided to strengthen and stiffen the mounting connections between the shadow mask and its support frame, each plate comprising a planar portion 62 overlying the step portion 22 of the shadow mask, a flange or tab portion 61 spot welded to the support frame at points B, and an upwardly angled, curved portion 63 overlying the similarly curved, unapertured portion 23 of the shadow mask and spot welded thereto at points C. The beneficial effects of the reinforcing plates in such a construction in significantly reducing Z axis or Q distance deviations of the critical central apertured portion 24 of the shadow mask due to both thermal deformation and mechanical shock are illustrated in FIG. 5(B) and FIG. 6(B), respectively. Moreover, the reinforcing plates not only reduce the magnitude of shadow mask deviations due to mechanical shock, as when the support frame is struck by a hammer, but more rapidly attenuate or dampen out any such vibrational deviations as comparatively shown by the solid curve a in FIG. 8 for a conventional mounting arrangement without any reinforcing plates and the dashed curve b for a construction embodying reinforcing plates in accordance with the invention.

Figure 9A:
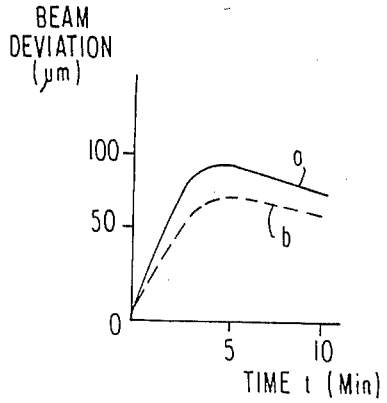
FIG. 9(A) and FIG. 9(B) are time plots showing electron beam deviation due to the thermal deformation of the shadow mask at the center and edge portions of the phosphor screen, respectively, for both the conventional and prior art constructions.
Figure 9B:
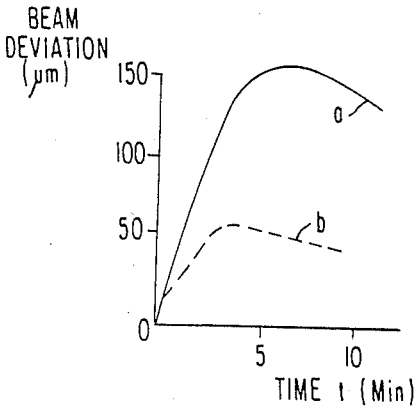

Similar comparative curves a (solid/conventional) and b (dashed/invention) are shown in FIGS. 9(A) and 9(B) to illustrate the decreased electron beam deviations due to the thermal deformation of the shadow mask in the central and edge portions thereof, respectively, resulting from the use of reinforcing plates in accordance with the invention. Such curves evidence a beam deviation or misalignment reduction of about 20% in the central portion of the picture tube and about 60% in the edge portions thereof.

With a support frame thickness of from 1.2 mm to 2.0 mm and a shadow mask thickness of from 0.1 mm to 0.3 mm, which are conventional dimensional ranges in the industry, test results have indicated that the reinforcing plates should preferably be at least three times as thick as the shadow mask in order to maximize the beneficial strengthening and stiffening effects of the plates. As one example, good vibrational damping was achieved in a color picture tube having a screen width (diagonal) of 37 inches with a shadow mask thickness of 0.25 mm, a support frame thickness of 2.0 mm, and reinforcing plate thicknesses of 1.0 mm.

Figure 10:
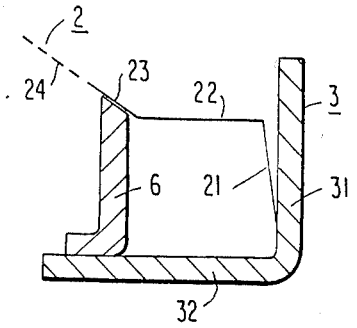
FIG. 10, FIG. 11 and FIG. 12 are edge sections of second, third and fourth embodiments of the invention.
Figure 11:
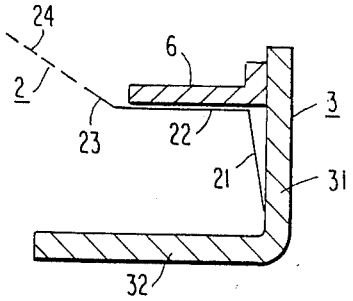
Figure 12:
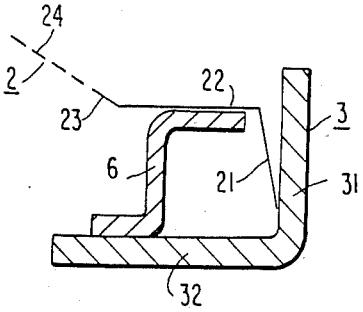

As various alternative configurations, FIG. 10 shows a second embodiment of the invention wherein the reinforcing plates 6 are disposed between the flange portion 32 of the support frame and the initial curved portion 23 of the shadow mask, FIG. 11 shows a third embodiment wherein the radially innermost portions of the reinforcing plates have been eliminated, and FIG. 12 shows a fourth embodiment wherein the reinforcing plates have a reverse bent, double L configuration.

Preferably just one or two reinforcing plates are provided on each of the four sides of the shadow mask/support frame mounting to avoid any wavy thermal deformations of the mask which might result from the use of too many reinforcing plates. Further, with picture tube screens having the phosphors laid out in striped rather than dot matrix patterns, the reinforcing plates need only be provided on the laterally opposite or short sides of the shadow mask since minor beam deviations in the vertical or Y axis direction are easily tolerated.

What is claimed is:

1. A mounting arrangement for securing the peripheral edge of an apertured, generally rectangular shadow mask to a similarly rectangular support frame in a color television picture tube assembly, comprising:

(a) a support frame (3) having an L-shaped cross-section including an inwardly directed flange portion (32) generally perpendicular to a Z axis of a picture tube and a skirt portion (31) generally parallel to said Z axis, (b) a shadow mask (2) disposed within the support frame and having a peripheral edge portion defined by, from an outer edge towards a center of the mask, an unapertured skirt member (21) lying within and alongside of the skirt portion of the support frame and approximately parallel to said Z axis, an unapertured planar step portion (22) generally perpendicular to said Z axis and substantially spaced from the flange portion of the support frame, an unapertured curved portion (23) inclined to the step portion, and a curved, regularly apertured central portion (24), (c) a plurality of spaced plug welds securing an edge of the shadow mask skirt member remote from the step portion to the support frame skirt portion proximate the flange portion, and (d) means for strengthening and stiffening the peripheral edge portion of the shadow mask both per se and relative to the support frame to reduce Z axis deviations of the mask due to thermal deformation and/or mechanical shock and attendantly reduce misalignment between the mask apertures and phosphors on a viewing screen (1) of the tube assembly, said strengthening and stiffening means comprising a plurality of spaced, rigid reinforcing plates (6), each having opposite end portions respectively joined to the support frame remote from the plug welds and to one of the step portion and the unapertured curved portion of the shadow mask.

2. A mounting arrangement according to claim 1, wherein each reinforcing plate includes a tab portion (61) joined to the skirt portion of the support frame, and an inwardly extending planar portion (62) supportively overlying the step portion of the shadow mask.

3. A mounting arrangement according to claim 2, wherein each reinforcing plate further includes a curved portion (63) inclined to the planar portion, supportively overlying the unapertured curved portion of the shadow mask, and joined thereto.

4. A mounting arrangement according to claim 1, wherein each reinforcing plate includes a tab portion joined to the flange portion of the support frame, and a strut portion extending parallel to the skirt portion of the support frame and spaced therefrom, and having an end remote from the tab portion joined to the unapertured curved portion of the shadow mask.

5. A mounting arrangement according to claim 1, wherein each reinforcing plate has a reverse bent, double L configuration defined by parallel, oppositely extending end arms and an intermediate strut portion, one of the end arms being joined to the flange portion of the support frame and the other end arm supportively underlying the step portion of the shadow mask, and joined thereto.

6. A mounting arrangement according to claim 1, wherein each reinforcing plate is at least three times thicker than the shadow mask.

7. A mounting arrangement according to claim 6, wherein the screen phosphors are laid out in a striped pattern, and reinforcing plates are provided only on laterally opposite, short sides of the shadow mask.

* * * * *